US009861981B2

(12) United States Patent
Cho et al.

(10) Patent No.: US 9,861,981 B2
(45) Date of Patent: Jan. 9, 2018

(54) PARTICLE PROCESSING DEVICE USING MEMBRANE STRUCTURES

(71) Applicant: KOREA ADVANCED INSTITUTE OF SCIENCE AND TECHNOLOGY, Daejeon (KR)

(72) Inventors: Young-Ho Cho, Daejeon (KR); Yoon-Ji Kim, Daegu (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 321 days.

(21) Appl. No.: 14/402,945

(22) PCT Filed: May 3, 2013

(86) PCT No.: PCT/KR2013/003837

§ 371 (c)(1),
(2) Date: Mar. 19, 2015

(87) PCT Pub. No.: WO2013/176416

PCT Pub. Date: Nov. 28, 2013

(65) Prior Publication Data

US 2015/0192504 A1 Jul. 9, 2015

(30) Foreign Application Priority Data

May 21, 2012 (KR) ..... 10-2012-0053893
Feb. 27, 2013 (KR) ..... 10-2013-0021072

(51) Int. Cl.
*B01L 3/00* (2006.01)

(52) U.S. Cl.
CPC ..... *B01L 3/50273* (2013.01); *B01L 3/502753* (2013.01); *B01L 3/502761* (2013.01); *B01L 2200/0631* (2013.01); *B01L 2200/0652* (2013.01); *B01L 2200/0668* (2013.01); *B01L 2300/0645* (2013.01);

(Continued)

(58) Field of Classification Search
CPC ..... B01L 3/502753; B01L 2200/0631; B01L 2200/0652; B01L 2200/0668; B01L 2300/0645; B01L 2300/0816; B01L 2300/0851; B01L 2300/0864;

(Continued)

(56) References Cited

U.S. PATENT DOCUMENTS

2008/0057274 A1 3/2008 Hagiwara et al.

FOREIGN PATENT DOCUMENTS

JP 20021182749 A 6/2002
KR 2011/0090672 A 8/2011

(Continued)

OTHER PUBLICATIONS

PCT Search Report of the ISA for PCT/KR2013/003837 dated Sep. 2, 2013.

(Continued)

*Primary Examiner* — Samuel P Siefke
(74) *Attorney, Agent, or Firm* — Daly, Crowley, Mofford & Durkee, LLP

(57) ABSTRACT

A particle processing device includes a chamber including an input portion and an output portion and providing a space for flowing of a fluid having a particle, at least two deformable membrane structures sequentially arranged in the chamber and controlling a sectional area of a fluid path through which the fluid flows, and at least two membrane control lines respectively applying pressure to the deformable membrane structures.

15 Claims, 20 Drawing Sheets

(52) U.S. Cl.
CPC ..... *B01L 2300/0816* (2013.01); *B01L 2300/0851* (2013.01); *B01L 2300/0864* (2013.01); *B01L 2400/0481* (2013.01); *B01L 2400/0655* (2013.01); *B01L 2400/086* (2013.01)

(58) Field of Classification Search
CPC ..... B01L 2400/0481; B01L 2400/0655; B01L 2400/086; B01L 3/50273; B01L 3/502761
See application file for complete search history.

(56) References Cited

FOREIGN PATENT DOCUMENTS

| | | | |
|---|---|---|---|
| KR | 2011/0101900 | A | 9/2011 |
| KR | 2011/0127059 | A | 11/2011 |

OTHER PUBLICATIONS

PCT Written Opinion of the ISA for PCT/KR2013/003037 dated Sep. 2, 2013.

14

17

PARTICLE PROCESSING DEVICE USING MEMBRANE STRUCTURES

CLAIM OF PRIORITY

This application claims priority under 35 USC §119 to Korean Patent Application No. 2012-0053893, filed on May 21, 2012 and Korean Patent Application No. 2013-0021072, filed on Feb. 27, 2013 in the Korean Intellectual Property Office (KIPO), the contents of which are herein incorporated by reference in their entirety.

BACKGROUND

1. Field

Example embodiments relate to a particle processing device. More particularly, example embodiments relate to a particle processing device capable of separating and collecting a particle in fluid using a membrane structure.

2. Description of the Related Art

Generally, one of technologies of detecting and capturing a micro-particle in a fluid may use a single filter layer having a hole or slit for filtering out the particle from the fluid. However, in case of using the single fixed filter, particles having different sixes can not be separated in one device. Further, although particles having a specific size are separated, there are difficulties in collecting the separated particle.

SUMMARY

Example embodiments provide a particle processing device capable of separating particles having different sizes and easily collecting the separated particles using a deformable membrane structure.

According to example embodiments, a particle processing device includes a chamber including an input portion and an output portion and providing a space for flowing of a fluid having a particle, at least two deformable membrane structures sequentially arranged in the chamber and controlling a sectional area of a fluid path through which the fluid flows, and at least two membrane control lines respectively applying pressure to the deformable membrane structures.

In example embodiments, the membrane control line may include a recess which is formed in an inner wall of the chamber to extend along a direction substantially perpendicular to a flow direction of the fluid.

In example embodiments, the deformable membrane structure may seal tightly the membrane control line to constitute a portion of the inner wall of the chamber.

In example embodiments, the membrane control line may be connected to a pressure source to deform the deformable membrane structure by the applied pressure.

In example embodiments, the membrane control lines may include a first membrane control line and a second membrane control line, and the deformable membrane structure deformed by the first membrane control line may have a first width and the deformable membrane structure deformed by the second membrane control line may have a second width different from the first width.

In example embodiments, the deformable membrane structures may include a first deformable membrane structure and a second deformable membrane structure, and the first deformable membrane structure may have a first thickness and the second deformable membrane structure may have a second thickness different from the first thickness.

In example embodiments, the deformable membrane structures may include a first deformable membrane structure and a second deformable membrane structure, and a first pressure may be applied to the first deformable membrane structure and a second pressure different from the first pressure may be applied to the second deformable membrane structure.

In example embodiments, the particle processing device may further include a recovery line which is connected to the chamber such that the particle processed by the deformable membrane structure is collected through the recovery line.

In example embodiments, the recovery line may extend corresponding to the membrane control line to collect the particle separated by each of the membrane control lines.

In example embodiments, the particle processing device may further include a deformable valve structure for opening and closing the recovery line and a valve control line for applying pressure to the deformable valve structure.

In example embodiments, the valve control line may include a recess which extends in an inner wall of the recovery line, and the deformable valve structure may seal tightly the valve control line to constitute a portion of the inner wall of the recovery line.

In example embodiments, the valve control line and the membrane control line may be connected to each other to be one recess, and the deformable valve structure and the deformable membrane structure may be connected to each other to be one deformable membrane.

In example embodiments, the particle processing device may further include a biochemical material layer coated on the inner wall of the chamber or on the deformable membrane structure. A particle captured by the deformable membrane structure may be adhered to and cultivated on the material layer. The particle captured by the deformable membrane structure may be secondly separated by a biochemical reaction with the material layer.

In example embodiments, the particle processing device may further include an additional structure on an inner wall of the chamber or on the deformable membrane structure to control a sectional area of a fluid channel through which the fluid flows.

In example embodiments, the particle processing device may further include a guiding structure on an inner wall of the chamber adjacent to the deformable membrane structure to control a flow direction of the fluid.

In example embodiments, the particle processing device may further include a pair of electrodes an inner wall of the chamber adjacent to the deformable membrane structure.

According to example embodiments, a particle processing device may separate particles having different sizes at a time and collect the separated particles without loss.

BRIEF DESCRIPTION OF THE DRAWINGS

Example embodiments will be more clearly understood from the following detailed description taken in conjunction with the accompanying drawings. FIGS. 1 to 28 represent non-limiting, example embodiments as described herein.

FIG. 1 is a view illustrating a particle processing device in accordance with example embodiments, FIG. 2 is a cross-sectional view taken along the line A-A' line in FIG. 2.

FIG. 3 is a cross-sectional view illustrating deformations of deformable membrane structures in FIG. 2.

FIG. 4 is a plan view illustrating a particle processing device in accordance with example embodiments.

FIG. 5 is a cross-sectional view taken along the line B-B' in FIG. 4.

FIG. 6 is a plan view illustrating a particle processing device in accordance with example embodiments.

FIG. 7 is & cross-sectional view taken along the line C-C in FIG. 6.

FIG. 8 is a cross-sectional view illustrating deformations of deformable membrane structures in FIG. 7.

FIG. 11 is a plan view illustrating a particle processing device in accordance with example embodiments.

FIG. 12 is a cross-sectional view taken along rise line D-D' FIG. 11.

FIG. 14 is a plan view illustrating a particle processing device in accordance with example embodiments.

FIG. 15 is a cross-sectional view taken along the line E-E' in FIG. 14.

FIG. 17 is a plan view illustrating a particle processing device in accordance with example embodiments, FIG. 18 is a cross-sectional view taken along the line F-F' in FIG. 17.

FIG. 21 is a plan view illustrating a particle processing device in accordance with example embodiments.

FIG. 22 is a cross-sectional view taken along the line G-G' in FIG. 21.

FIG. 23 is a plan view illustrating a particle processing device in accordance with example embodiments, FIG. 24 is a plan view illustrating a particle processing device in accordance with example embodiments, FIG. 25 is a cross-sectional view taken along the line H-H' in FIG. 24.

FIG. 27 is a plan view illustrating a particle processing device in accordance with example embodiments, FIG. 28 is a plan view illustrating a particle processing device in accordance with example embodiments.

DESCRIPTION OF EMBODIMENTS

Figure 1:
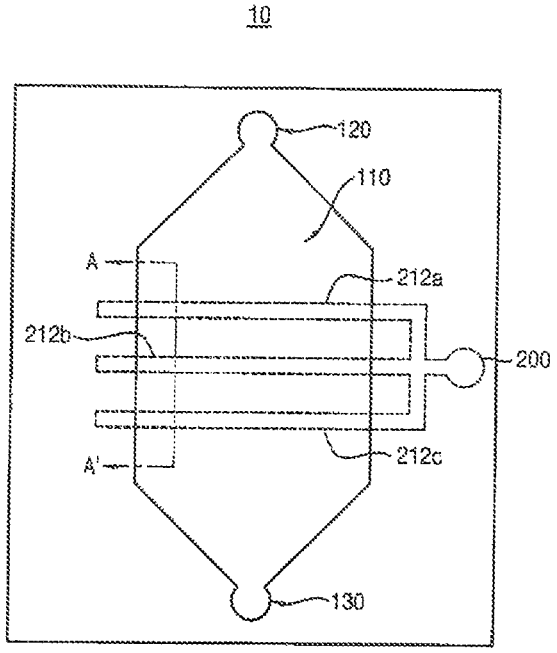

Various example embodiments will be described more felly hereinafter with reference to the accompanying drawings, in which some example embodiments are shows. The present inventive concept may, however, be embodied in many different forms and should not be construed as limited to the example embodiments set forth herein. Rather, these example embodiments are provided so that this description will be thorough and complete, and will felly convey the scope of the present inventive concept to those skilled in the art. In the drawings, the sizes and relative sizes of layers and regions may be exaggerated for clarity.

It will be understood that when an element or layer is referred to as being "on," "connected to" or "coupled to" another dement or layer, it can be directly on, connected or coupled to the other element or layer or intervening elements or layers may be present. In contrast when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, fourth etc, may be used herein to describe various elements, components, regions, layers and/or sections, these elements, components, regions, layers and/or sections should not be limited by these terms. These terms are only used to distinguish one element component, region, layer or section from another region, layer or section. Thus, a first element, component, region, layer or section, discussed below could be termed a second element, component, region, layer or section without departing from the teachings of the present inventive concept.

Spatially relative terms, such as "beneath," "below," "lower," "above," "upper" and the like, may be used herein for ease of description to describe one element or feature's relationship to another elements) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly, The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood feat the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
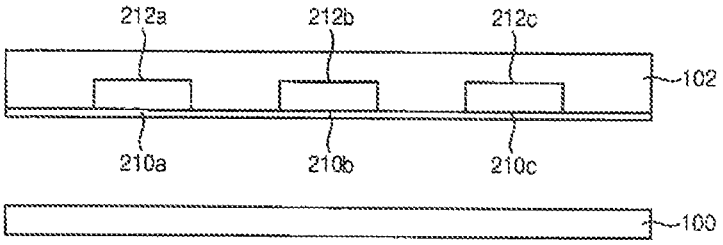
Figure 3:
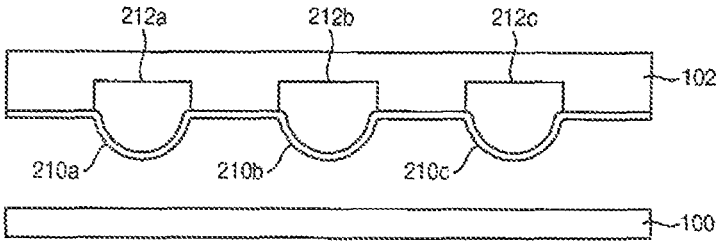

FIG. 1 is a view illustrating a particle processing device in accordance with example embodiments. FIG. 2 is a cross-sectional view taken along the line A-A' line in FIG. 2. FIG. 3 is a cross-sectional view illustrating deformations of deformable membrane structures in FIG. 2.

Referring to FIGS. 1 to 3, a particle processing device 10 may include a chamber 110, at least two deformable membrane structures 210*a*, 210*b*, 210*c*, and at least two membrane control lines 212*a*, 212*b*, 212*c*.

The chamber 110 may include an input portion 120 and an output portion at both end portions thereof. The chamber 110 may provide a space for fluid flow. The chamber 110 may have a polygonal sectional shape. A fluid may flow into the chamber 110 through the input portion 120 and flow out of the chamber 110 through the output portion 330. For example, a fluid supply element (not illustrated) may be connected to the input portion 120 and the output portion 130 to supply the fluid into the chamber or discharge the fluid from the chamber.

For example, the fluid may be a solution including biological particles. Examples of the solution may be blood, bodily fluid, cerebrospinal fluid, urine, spectrum, a mixture thererof, a diluted solution thereof, etc. Examples of the particle may be tissue, cell, protein, nucleic acid, an aggregate thereof, a mixture thereof, etc.

The first, second and third deformable membrane structures 210*a*, 210*b*, 210*c* may be sequentially arranged in the chamber 110. The first, second and third deformable membrane structures 210*a*, 210*b*, 210*c* may be spaced apart from each other in a first direction, that is, a flow direction of a fluid. The first, second and third membrane control lines 212*a*, 212*b*, 212*c* may be arranged respectively corresponding to the first, second and third deformable membrane structures 210*a*, 210*b*, 210*c* to apply pressure to the first, second and third deformable membrane structures 210*a*, 210*b*, 210*c*, thereby deforming each of the deformable membrane structures. Accordingly, the first, second and third deformable membrane structures 210*a*, 210*b*, 210*c* may be deformed respectively to control a sectional area of a fluid path through which the fluid flows, The chamber 110 and the membrane control lines may be formed by semiconductor manufacture processes including photolithography, growth and etching of crystal structure, etc. For example, the chamber 110 may be formed using polymer material, inorganic material, etc. Examples of the polymer material may be PDMS (polydimethylsiloxane), PMMA (polymethylmethacrlyate), etc. The examples of the inorganic material may be glass, quartz, silicon, etc.

In example embodiments, the particle processing device 10 may include a first substrate 100 and a second substrate 102. The second substrate 102 may be formed on the first substrate 100 such that the chamber and the membrane control lines may be defined between the first and second substrates 100 and 102.

As illustrated in FIGS. 1 and 2, an opening for forming the chamber may be formed in the first substrate 100, and recesses for forming the membrane control lines may be formed in the second substrate 102, A deformable membrane 210 may be formed on the second substrate 102 to tightly seal the recesses such that the deformable membrane structures may be formed to constitute a portion of an inner wall of the chamber. For example, the deformable membrane 210 may be formed using PDMS. Accordingly, a surface of the first substrate 100 may constitute a lower wall of the chamber 110 and a surface of the second substrate 102 may constitute an upper wall of the chamber 110.

The first membrane control line 212*a* may include the recess which is formed in the inner wall of the chamber, that is, the surface of the second substrate 102 to extend along a second direction substantially perpendicular to the first direction. The first deformable membrane structure 210*a* may seal tightly the first membrane control line 212*a* to form a pressure line and constitute a portion of the inner wall of the chamber 110.

The second membrane control line 212*b* may include the recess which is formed in the surface of the second substrate 102 to extend along the second direction and is spaced apart from the first membrane control line 212*a*. The second deformable membrane structure 210*b* may seal tightly the second membrane control line 212*b* to form a pressure line and constitute a portion of the inner wall of the chamber 110.

The third membrane control line 212*c* may include the recess which is formed in the surface of the second substrate 102 to extend along the second direction and is spaced apart from the second membrane control line 212*b*. The third deformable membrane structure 210*c* may seal tightly the third membrane control line 212*c* to form a pressure line and constitute a portion of the inner wall of the chamber 110.

The first membrane control line 212*a* may be connected to a common pressure source 200 to deform the first deformable membrane structure 210*a* using an applied pressure. The second membrane control line 212*b* may be connected to the common pressure source 200 to deform the second deformable membrane structure 210*b* using an applied pressure. The third membrane control line 212*c* may be connected to the common pressure source 200 to deform the second deformable membrane structure 210*c* using an applied pressure. For example, the common pressure source may apply a same pressure to each of the first to third membrane control lines 212*a*, 212*b*, 212*c*.

As illustrated in FIG. 3, when a pressure is applied to the first to third membrane control lines 212*a*, 212*b*, 212*c* by the common pressure source 200, the first to third deformable membrane structures 210*a*, 210*b*, 210*c* may be deformed toward the first substrate 100 to form fluid channels in the chamber 110 respectively. The fluid channel may have a predetermined sectional shape for selectively capturing a particle in the fluid. As the pressure of the first to third membrane control lines 212*a*, 212*b*, 212*c* is decreased to be removed, each of the first to third deformable membrane structures 210*a*, 210*b*, 210*c* may return to its original position to pass the captured particle.

Accordingly, the first to third deformable membrane structures may be deformed elastic-ally by the pressure to control the sectional area of the chamber 110 such that a particle in the fluid may be detect and captured and the captured particle may be collected.

Figure 4:
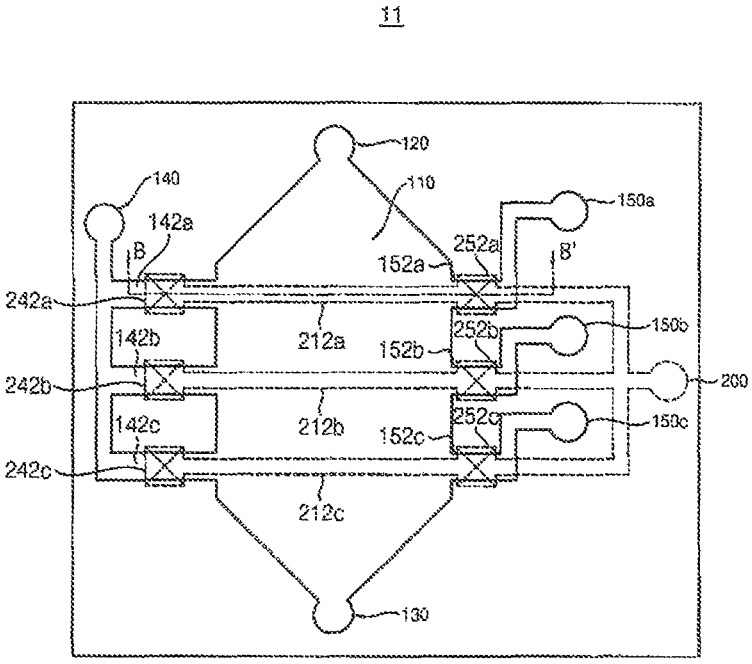
Figure 5:
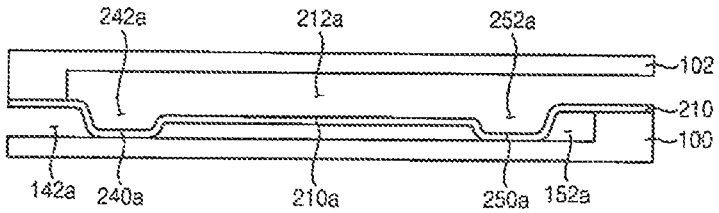

FIG. 4 is a plan view illustrating a particle processing device in accordance with example embodiments. FIG. 5 is a cross-sectional view taken along the line B-B' in FIG. 4, The device is substantially the same as the particle processing device described with reference to FIG. 1 except for a recovery line and a control means thereof. Thus, the same reference numerals will be used to refer to the same or like elements and any further repetitive explanation concerning the above elements will be omitted.

Referring to FIGS. 4 and 5, a particle processing device 11 may include a chamber 110, at least two deformable membrane structures 210*a*, 210*b*, 210*c*, at least two membrane control lines 212*a*, 212*b*, 212*c*, at least one recovery line and a control means for controlling flowing through the recovery line.

A plurality of recovery lines may be connected to the chamber 110 such that the particles processed by the deformable membrane structures may be collected through the recovery line.

In particular, first second and third common recovery lines 142*a*, 142*b*, 142*c* may be formed to be spaced apart from each other along a first side portion of the chamber 110. The first, second and third common recovery lines 142*a*. 1.42*b*, 142*c* may be connected to a common recovery portion 140.

First, second and third individual recovery lines 152*a*, 152*b*, 152*c* may be formed to be spaced apart from each other along a second side portion opposite to the first side portion of the chamber 110. The first individual recovery line 152*a* may be connected to a first individual recovery portion 150*a*, the second individual recovery line 152*b* may be connected to a second individual recovery portion 150*b*, and the third individual recovery line 152*c* may be connected to a third individual recovery portion 150*c*.

The first common recovery line 142*a* and the first individual recovery line 152*a* may extend in the first substrate 100 corresponding to the first membrane control line 212*a*. The second common recovery line 142*b* and the second individual recovery line 152*b* may extend in the first substrate 100 corresponding to the second membrane control line 212*b*. The third common recovery line 142*c* and the third individual, recovery line 152*c* may extend in the first substrate 100 corresponding to the third membrane control line 212*c*.

Use control means for controlling flowing through the recovery line may include a deformable valve structure for opening and closing the recovery line and a valve control line for applying pressure to the deformable valve structure.

As illustrated in FIG. 5, a first common valve control line 242*a* may include a recess which extends in an inner wall of the first common recovery line 142*a*, that is, the surface of the second substrate 102. A first common deformable valve structure 240*a* may seal tightly the first common valve control line 242*a* to form a pressure line and constitute a portion of the inner wall of the first common recovery line 142*a*.

A first individual valve control line 252*a* may include a recess which extends in an inner wall of the first individual recovery line 152*a*, that is, the surface of the second substrate 102. A first individual deformable valve structure 250*a* may seal tightly the first individual valve control line 252*a* to form a pressure line and constitute a portion of the inner wall of the first individual recovery line 152*a*.

In this embodiment, the first common valve control line 242*a*, the first membrane control line 212*a* and the first individual valve control line 252*a* may include one recess which extends in a direction substantially perpendicular to the fluid flow direction. The first common deformable valve structure 240*a*, the first deformable membrane structure 210*a* and the first individual deformable valve structure 250*a* may include one deformable membrane which is formed on the second substrate 102 to cover the one recess.

Although it is not illustrated in the figures, a second common valve control line may include a recess which extends in an inner wall of the second common recovery line 142*b*, that is, the surface of the second substrate 102, similarly to the first common valve control line 242*a*. A second common deformable valve structure may seal tightly the second common valve control line to form a pressure line and constitute a portion of the inner wall of the second common recovery line 142*b*.

A second individual valve control line may include a recess which extends in an inner wall of the second individual recovery line 152*b*, that is, the surface of the second substrate 102, similarly to the first individual valve control line 252*a*. A second individual deformable valve structure may seal tightly the second individual valve control line to form a pressure line and constitute a portion of the inner wall of the second individual recovery line 152*b*.

A third common valve control line may include a recess which extends in an inner wall of the third common recovery line 142*c*, that is, the surface of the second substrate 102, similarly to the first common valve control line 242*a*. A third common deformable valve structure may seal tightly the third common valve control line to form a pressure line and constitute a portion of the inner wall of the third common recovery line 142*c*.

A third individual valve control line may include a recess which extends in an inner wall of the third individual recovery line 152*c*, that is, the surface of the second substrate 102, similarly to the first individual valve control line 252*a*. A third individual deformable valve structure may seal tightly the third individual valve control line to form a pressure line and constitute a portion of the inner wall of the third individual recovery line 152*c*.

When a pressure is applied to the first individual control line 252*a*, the first membrane control line 212*a* and the first common valve control line 242*a* by & common pressure source 200, the first individual deformable valve structure 250*a*, the first deformable membrane structures 210*a* and the first common deformable valve structure 240*a* may be deformed toward the first substrate 100 to form a fluid channel in the chamber 110 and close the first individual recovery line 152*a* and the first common recovery line 142*a*, respectively. As the pressure of the first individual valve control line 252*a*, the first membrane control line 212*a* and the first common valve control line 242*a* is decreased to be removed, each of the first individual deformable valve control line 250*a*, the first deformable membrane structure 210*a* and the first common deformable valve control line 240*a* may return to its original position.

Accordingly, the first deformable membrane structure may be deformed elastically by the pressure to control the sectional area of the chamber 110 such that a particle in the fluid may be detected and captured by the first deformable membrane structure and the captured particle may be collected through the first individual recovery line or the first common recovery line.

Similarly, the second and third deformable membrane structures may be deformed elastically by the pressure to control the sectional area of the chamber 110 such that a particle in the fluid may be detected and captured by the second and third deformable membrane structures and the captured particle may be collected through the second and third individual recovery lines or the second and third common recovery lines.

Figure 6:
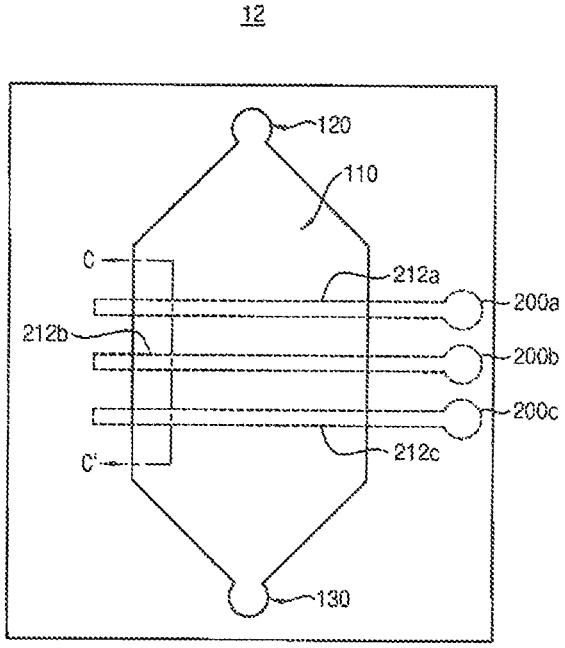
Figure 7:
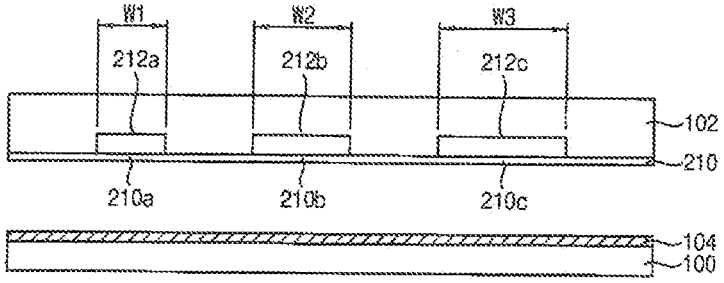
Figure 8:
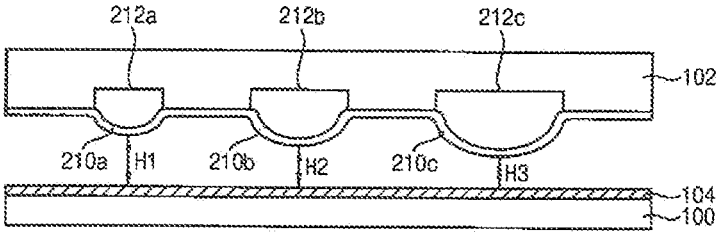

FIG. 6 is a plan view illustrating a particle processing device in accordance with example embodiments. FIG. 7 is a cross-sectional view taken along the line C-C' in FIG. 6. FIG. 8 is a cross-sectional view illustrating deformations of deformable membrane structures in FIG. 7. The device is substantially the same as the particle processing device described with reference to FIG. 1 except for a pressure source, widths of membrane control lines and a material layer. Thus, the same reference numerals will be used to refer to the same or like elements and any further repetitive explanation concerning the above elements will be omitted.

Referring to FIGS. 6 to 8, a particle processing device 12 may include individual pressure sources 200*a*, 200*b*, 200*e* respectively connected to membrane control lines 212*a*, 212*b*, 212*c*.

A first membrane control line 212*a* may be connected to a first individual pressure source 200*a* to apply pressure to a first deformable membrane structure 210*a*, thereby deforming the first deformable membrane structure 210*a*. A second membrane control line 212*b* may be connected to a second individual pressure source 200*b* to apply pressure to a second deformable membrane structure 210*b*, thereby deforming the second deformable membrane structure 210*b*. A third membrane control line 212*c* may be connected to a third individual pressure source 200*c* to apply pressure to a third deformable membrane structure 210*c*, thereby deforming the third deformable membrane structure 210*c*. The first to third membrane control lines may be connected to the individual pressure sources respectively and be controlled independently.

For example, a same pressure may be applied to the first to third membrane control lines 212*a*, 212*b*, 212*c*. Alternatively a different pressure may be applied to the first to third membrane control lines 212*a*, 212*b*, 212*c*. A pressure may be applied at the same time to the first to third membrane control lines 212*a*, 212*b*, 212*c* to simultaneously deform the first to third deformable membrane structures 210*a*, 210*b*, 210*c*. Alternatively, a pressure may be applied at different times to the first to third membrane control lines 212*a*, 212*b*, 212*c* to independently deform the first to third deformable membrane structures 210*a*, 210*b*, 210*c*.

As illustrated in FIGS. 7 and 8, the first membrane control line 212*a* may have a first width W1, the second membrane control line 212*b* may have a second width W2 greater than the first width W1, and the third membrane control line 212*c* may have a third width W3 greater than the second width W2.

When a pressure is applied to the first to third membrane control lines 212*a*, 212*b*, 212*c* respectively by the individual pressure sources, the first to third deformable membrane structures 210*a*, 210*b*, 210*c* may be deformed toward the first substrate 100 to form fluid channels in the chamber 110 respectively.

In this case, a length of the first deformable membrane structure 210*a* deformed by the first membrane control line 212*a* may be smaller than a length of the second deformable membrane structure 210*b* deformed by the second membrane control line 212*b*. The length of the second deformable membrane structure 210*b* deformed by the second membrane control line 212*b* may be smaller than a length of the third deformable membrane structure 210*c* deformed by the third membrane control line 212*c*.

Accordingly, the first deformable membrane structure 210*a* may form a fluid channel having a first height H1, the second deformable membrane structure 210*b* may form a fluid channel having a second height H2 greater than the first height H1, and the third deformable membrane structure 210*c* may form a fluid channel having a third height H3 greater than the second height H2. Accordingly, the sectional area of the fluid channel through which fee fluid flows may be controlled according to the widths of the membrane control lines.

In example embodiments, a particle processing device 12 may further include a biochemical material layer coated on the inner wall of the chamber 110 or on the deformable membrane structures 210*a*, 210*b*, 210*c*.

As illustrated in FIG. 7, a material layer 104 may be coated using collagen on the first substrate 100, A particle captured by the deformable membrane structure may be adhered to the material, layer 104 by a biochemical reaction to be cultivated thereon. In addition, as mentioned later, a fluid may flows through the input portion and the output portion such that the particle adhered to the material may be secondly separated from another particle which does not biochemically react with the material layer.

Hereinafter, a method of processing a particle using the particle processing device in FIG. 6 will be explained.

Figure 9A:
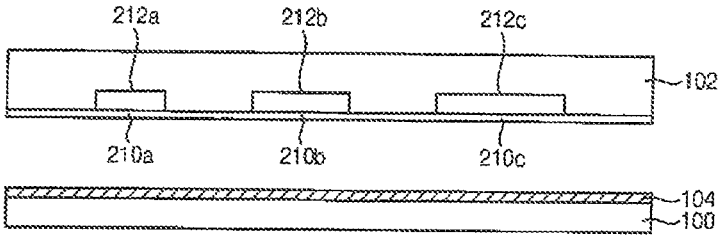
FIGS. 9A to 9C are cross-sectional views illustrating a method of processing a particle in accordance with example embodiments.
Figure 9B:
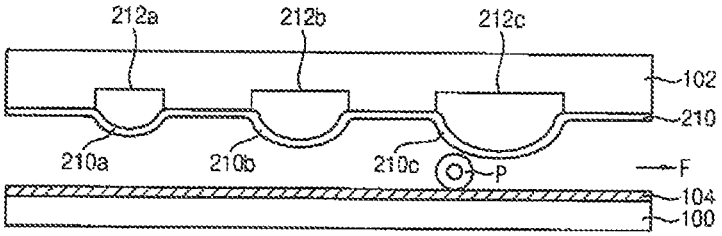
Figure 9C:
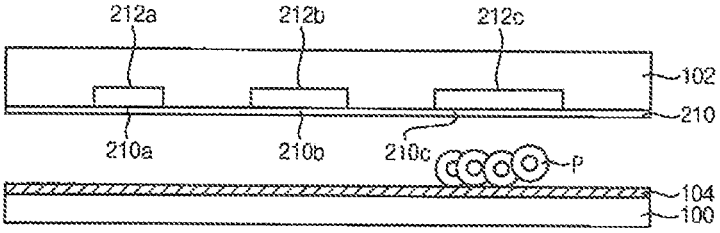

FIGS. 9A to 9C are cross-sectional views illustrating a method of processing a particle in accordance with example embodiments.

Referring to FIGS. 6, 9A and 9B, a pressure may the applied to the first to third membrane control lines 212*a*, 212*b*, 212*c* to deform the first to third deformable membrane structures 210*a*, 210*b*, 210*c*. Then, after a fluid including a particle flows into the chamber 110 through the input portion 120, the particle P in the fluid may be selectively separated by the deformable membrane structure.

The first to third deformable membrane structures 210*a*, 210*b*, 210*c* may be independently or simultaneously deformed. Further, a sectional area of a fluid channel through which the fluid flows may be controlled according to the widths of the first to third membrane control lines 212*a*, 212*b*, 212*c*.

Referring to FIG. 9C, after the pressure is decreased to be removed from the deformable membrane structure, the separated particle P may be cultivated on the material layer 104 in the chamber 110.

Then, the cultivated particles P may be collected through the output portion 130 or the recovery line (see FIG. 4).

Alternatively, as illustrated in FIG. 9B, after the particle is captured on the material layer 104 including collagen, the captured particle may biochemically react with the material layer 104 coated on the first substrate 100. For example, the captured particle may be cancer cell, and the cancer cell may biochemically react with the material layer 104 to have a greater adhesive strength with the material layer 104 than other cells (e.g., blood cells).

Accordingly, the captured particle may biochemically react with the material layer 104 for a period of time to be adhered to the material layer 104. After lapse of a time required for the reaction, a fluid having a predetermined velocity may flow such that different cells having a size or deformability similar or like the capture particle may be discharged to perform a second separation. After performing the second separation, the adhered particle may be cultivated itself, or a chemical agent may be used to remove the chemical reaction with the material layer and a recovery fluid may flow to collect the secondly separated particle.

Figure 10A:
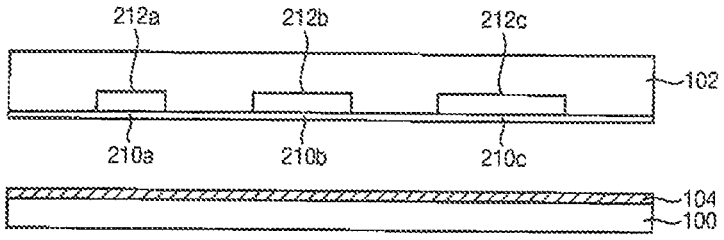
FIGS. 10A to 10C are cross-sectional views illustrating a method of processing a particle in accordance with example embodiments.
Figure 10B:
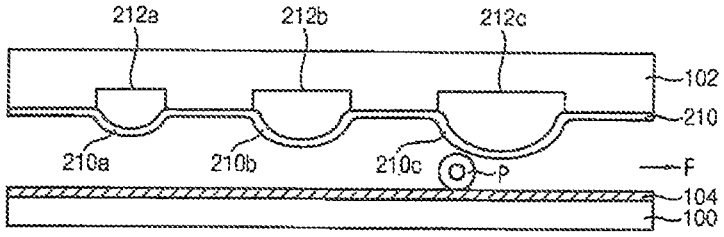
Figure 10C:
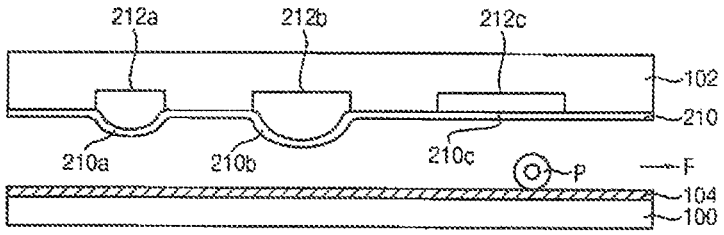

FIGS. 10A to 10C are cross-sectional views illustrating a method of processing a particle in accordance with example embodiments. The method is substantially the same as the method, of processing a particle described with reference to FIGS. 9A to 9C except for omission of a cultivating step. Thus, the same reference numerals will be used to refer to the same or like elements and any farther repetitive explanation concerning the above elements will be omitted.

Referring to FIGS. 6, 10A and JOB, a pressure may be applied to the first to third membrane control lines 212*a*, 212*b*, 212*c* to deform the first to third deformable membrane structures 210*a*, 210*b*, 210*c*. Then, after a fluid including a particle flows into the chamber 110 through the input portion 120, the particle P is the fluid may be selectively separated by the deformable membrane structure.

Referring to FIG. 10C, after the pressure is decreased to be removed from any one of the deformable membrane structures, the separated particle P may be collected.

For example, a particle having a first size may be captured by the first deformable membrane structure 210*a*, a particle having a second size greater than the first size may be captured by the second deformable membrane structure 210*b*, and a particle having a third size greater than the second size may be captured by the third deformable membrane structure 210*c*.

Then, in order to collect the captured particles, first, the pressure may be decreased to be removed from the third deformable membrane structure 210*c* such that the particle having the third size may be collected through the output portion. Then, the pressure may be sequentially decreased to be removed from the second deformable membrane structure 210*b* and the first deformable membrane structure 210*a* such that the particle having the second size and the particle having the first size may be sequentially collected.

Figure 11:
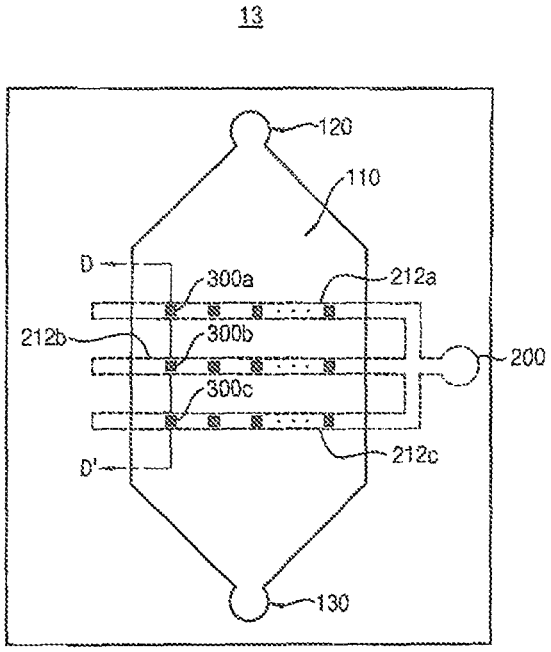
Figure 12:
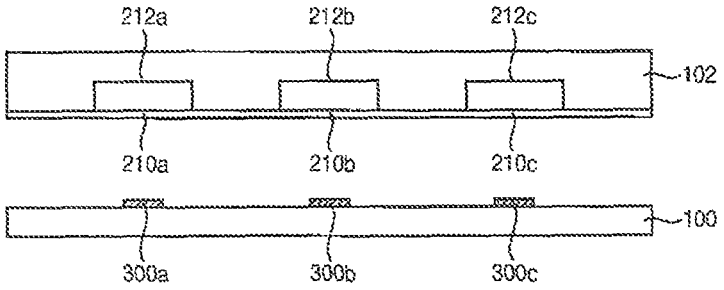

Alternatively, a pressure from the common pressure source may be decrease in stages such that the particle captured by the third deformable membrane structure 210*c* may be first collected, and then the particles captured by the second and first deformable membrane structures 210*b*, 210*a* may be sequentially collected, FIG. 11 is a plan view illustrating a particle processing device in accordance with example embodiments. FIG. 12 is a cross-sectional view taken along the line D-D' in FIG. 11. The device is substantially the same as the particle processing device described with reference to FIG. 1 except for an additional structure. Thus, the same reference numerals will be used to refer to the same or like elements and any further repetitive explanation concerning the above elements will be omitted.

Referring to FIGS. 11 and 12, a particle processing device 13 may further include an additional structure which is disposed on an inner wall of a chamber 110 or on a deformable membrane structure 210*a*, 210*b*, 210*c* to control a sectional area of a fluid channel through which a fluid flows.

A first additional structure 300*a* may be disposed on a first substrate 100 corresponding to a first deformable membrane structure 210*a*. A second additional structure 300*b* may be disposed on the first substrate 100 corresponding to a second deformable membrane structure 210*b*, A third additional structure 300*c* may be disposed on the first substrate 100 corresponding to a third deformable membrane structure 210*c*. The first to third additional structures 300*a*, 300*b*, 300*c* may be fixed structures and have various shape such as circular or polygonal shapes.

Accordingly, the first to third additional structures 300*a*, 300*b*, 300*c* may control the sectional area of the chamber through which the fluid flows, together with the first to third deformable membrane structures 210*a*, 210*b*, 210*c*.

FIGS. 13A to 13D are cross-sectional views illustrating various arrangements of the additional structures in FIG. 11.

Figure 13A:
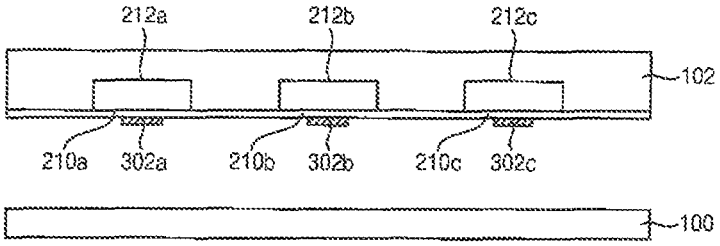
FIGS. 13A to 13D are cross-sectional views illustrating various arrangements of the additional structures in FIG. 11.

As illustrated in FIG. 13A, a fourth additional structure 302*a* may be disposed on the first deformable membrane structure 210*a*. A fifth additional structure 302*b* may be disposed on the second deformable membrane structure 201*b*, A sixth additional structure 302*c* may be disposed on the third deformable membrane structure 201*c*.

Figure 13B:
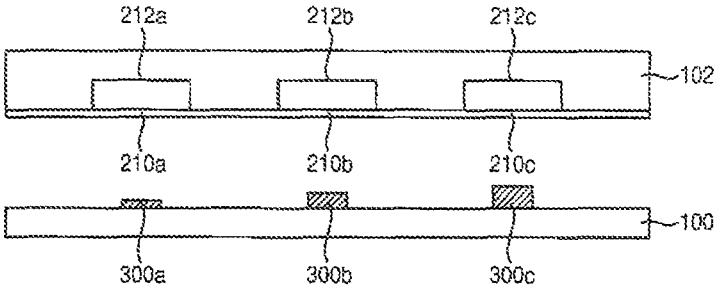

As illustrated in FIG. 13B, a first additional structure 300*a* may have a first height from the first substrate 100. A second additional structure 300*b* may have a second height from the first substrate 100. A third additional structure 300*c* may have a third height from the first substrate 100. The second height may be greater than the first height and the third height may be greater than the second height.

Figure 13C:
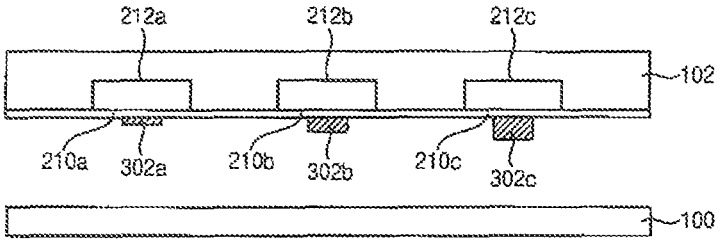

As illustrated in FIG. 13C, a fourth additional structure 302*a* may have a fourth height from the first deformable membrane structure 210*a*. A fifth additional structure 302*b* may have a fifth height from the second deformable membrane structure 210*b*. A sixth additional structure 302*c* may have a fifth height from the third deformable membrane structure 210*c*. The fifth height may be greater than the fourth height and the sixth height may be greater man the fifth height.

Figure 13D:
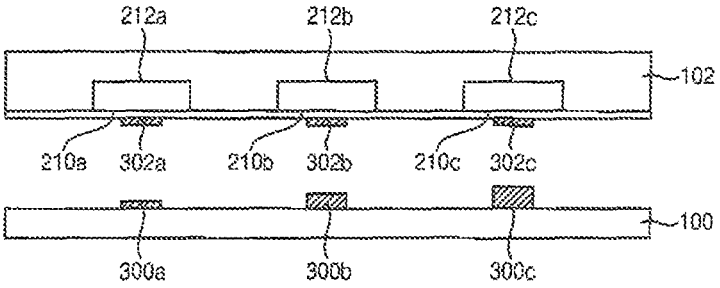

As illustrated in FIG. 13D, a first additional structure 300*a* may have a first, height from the first substrate 100. A second additional structure 300*b* may have a second height from the first substrate 100. A third additional structure 300*c* may have a third height from the first substrate 100. The second height may be greater than the first height and the third height may be greater than the second height.

A fourth additional structure 302*a* may have a fourth height from the first deformable membrane structure 210*a*. A fifth additional structure 302*b* may have a fifth height from the second deformable membrane structure 210*b*. A sixth additional structure 302*c* may have a fifth height from the third deformable membrane structure 210*c*. The fifth height may be greater than the fourth height and the sixth, height may be greater than the fifth height.

Figure 14:
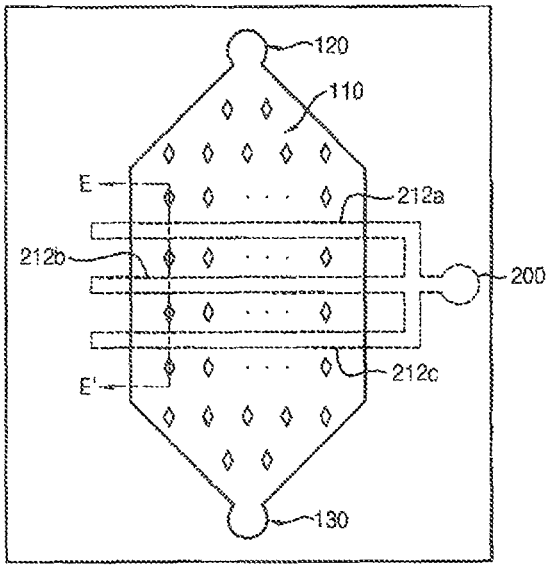
Figure 15:
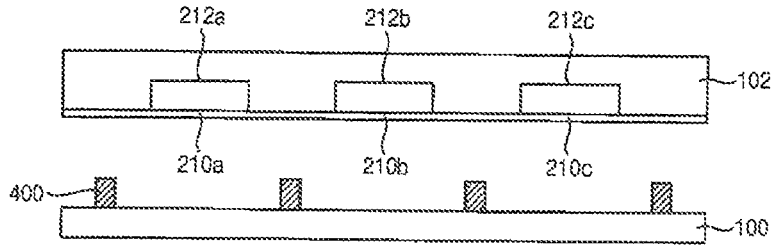

FIG. 14 is a plan view illustrating a particle processing device in accordance with example embodiments. FIG. 15 is a cross-sectional view taken, along the line E-E' in FIG. 14. The device is substantially the same as She particle processing device described with reference to FIG. 1 except for a guiding structure. Thus, the same reference numerals will be used to refer to the same or like elements and any further repetitive explanation concerning the above elements will be omitted.

Referring to FIGS. 14 and 15, a particle processing device 14 may further include a guiding structure which is disposed on an inner wall of a chamber 110 adjacent to a deformable membrane structure 210*a*, 210*b*, 210*c* to control a flow direction of a fluid. The guiding structure may control mixture or distribution of the fluid.

A plurality of guiding structures 400 may be arranged on a first substrate 100 to be spaced apart, from each other along a flow direction of a fluid. The guiding structures 400 may be disposed in front or rear of the deformable membrane structure 210*a*, 210*b*, 210*c* to control a fluid flow. The guiding structures 400 may be fixed structures and have various shape such as circular or polygonal shapes.

FIGS. 16A to 16D are cross-sectional views illustrating various arrangements of the guiding structures in FIG. 14.

Figure 16A:
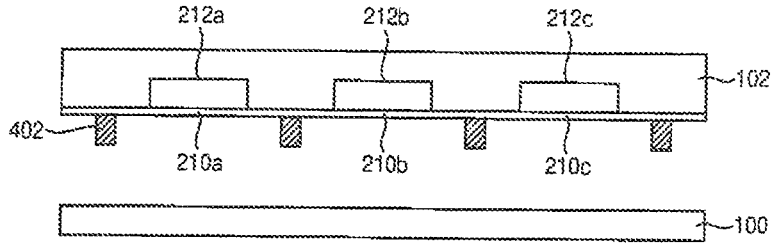
FIGS. 16A to 16D are cross-sectional views illustrating various arrangements of the guiding structures in FIG. 14.

As illustrated in FIG. 16A, guiding structures 402 may be disposed on a second substrate in front or rear of the deformable membrane structure 210*a*, 210*b*, 210*c* to control fluid flow.

Figure 16B:
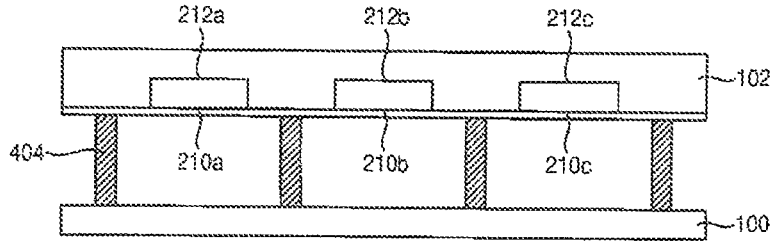

As illustrated in FIG. 16B, guiding structures 404 may have a column shape extending from the first substrate 100 to the second substrate 102.

Figure 16C:
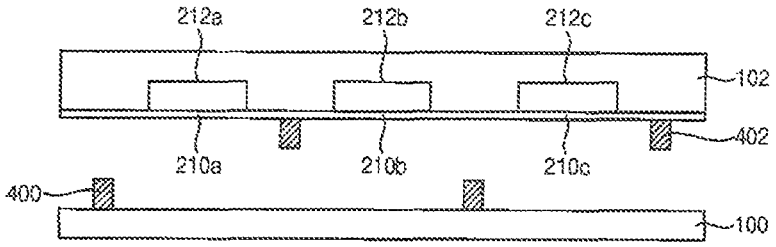

As illustrated in FIG. 16C, first guiding structures 400 may be disposed on the first substrate 100 and second guiding structures 402 may be disposed on the second substrate 102. The first and second guiding structures 400, 402 may be arranged alternately with each other not to overlap with each other.

Figure 16D:
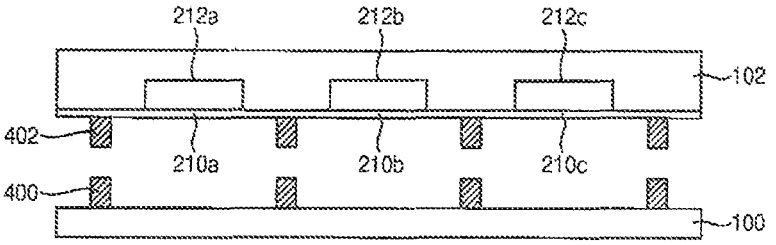

As illustrated is FIG. 16D, first guiding structures 400 may be disposed on the first substrate 100 and second guiding structures 402 may be disposed on the second substrate 102. The first and second guiding structures 400, 402 may be arranged to overlap with each other.

Figure 17:
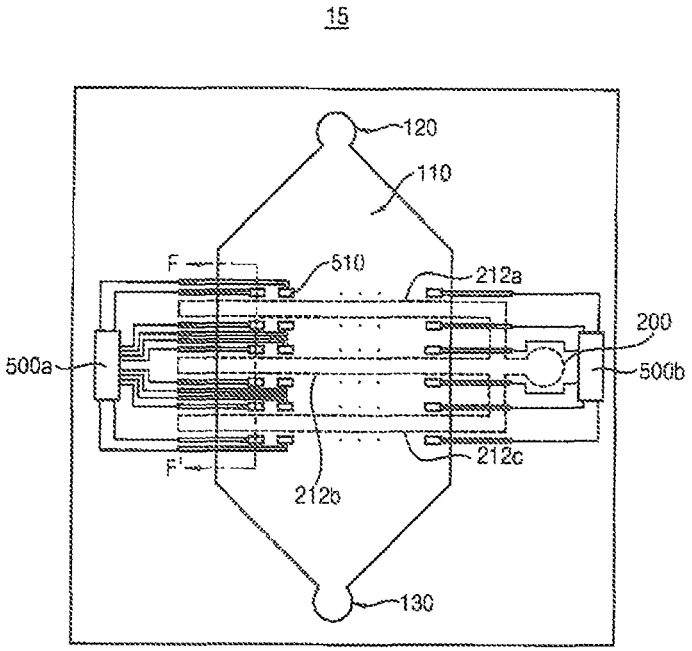
Figure 18:
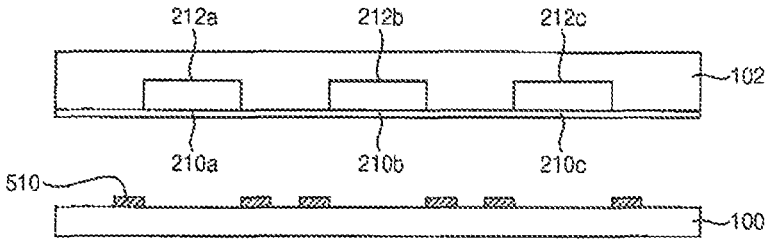

FIG. 17 is a plan view illustrating a particle processing device in accordance with example embodiments. FIG. 18 is a cross-sectional view taken along the line F-F' in FIG. 17. The device is substantially the same as the particle processing device described with reference to FIG. 1 except for an electrode structure. Thus, the same reference numerals will be used to refer to the same or like elements and any further repetitive explanation concerning the above elements will be omitted.

Referring to FIGS. 17 and 18, a particle processing device 15 may further include a pair of electrodes which are arranged on an inner wall of a chamber 110 adjacent to a deformable membrane structure 210*a*, 210*b*, 210*c*.

A pair of electrodes 510 may be arranged on a first substrate 110 to be spaced apart from each other. A pair of the electrodes 510 may be arranged in front or rear of the deformable membrane structure 210*a*, 210*b*, 210*c*. A pair of the electrodes 510 may be electrically connected to first and second power sources 500*a*, 500*b* to count or lyse particles passing through or being separated by the deformable membrane structure.

Figure 19A:
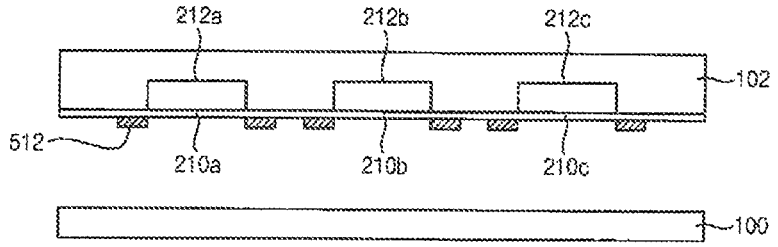
FIGS. 19A and 19B are cross-sectional views illustrating various arrangements of the electrode structures in FIG. 17.
Figure 19B:
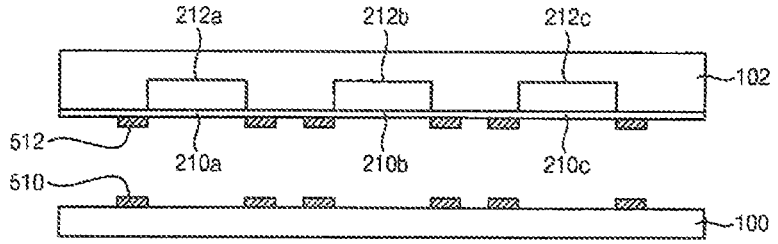

FIGS. 19A and 19B are cross-sectional views illustrating various arrangements of the electrode structures in FIG. 17.

As illustrated in FIG. 19A, a pair of electrodes 512 may be arranged on a second substrate 102 in front or rear of each of the deformable membrane structures 210*a*, 210*b*, 210*c*.

As illustrated in FIG. 19B, a pair of second electrodes 512 may be arranged on a second substrate 102 in front or rear of each of the deformable membrane structures 210*a*, 210*b*, 210*c*, and a pair of first electrodes 510 may be arranged on a first substrate 100 corresponding to the second electrodes 512.

Figure 20A:
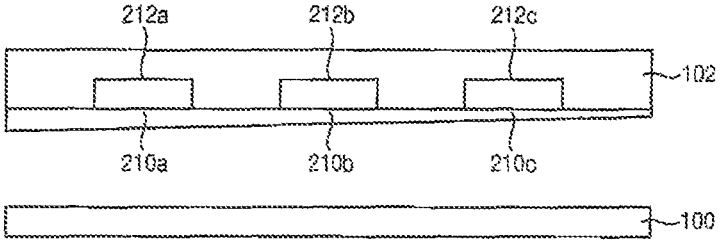
FIGS. 20A and 20B are cross-sectional views illustrating various shapes of deformable membrane structures.
Figure 20B:
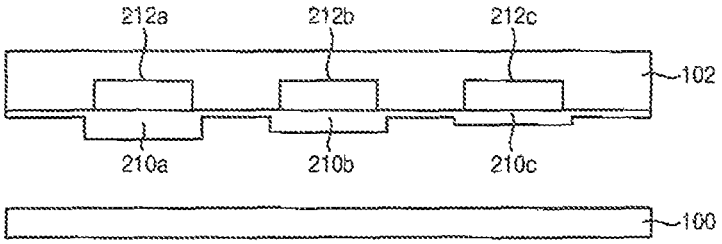

FIGS. 20A and 20B are cross-sectional views illustrating various shapes of deformable membrane structures.

Referring to FIGS. 20A and 20B, a first deformable membrane structure 210*a* may have a first thickness, a second deformable membrane structure 210*b* may have a second thickness greater than the -first thickness, and a third deformable membrane structure 210*c* may have a third thickness greater than the second thickness.

Accordingly, when a same pressure is applied to the first, second and third membrane control lines 212*a*, 212*b*, 212*c*, the first, second and third deformable membrane structures 210*a*, 210*b*, 210*c* may be deformed differently from one another according to the thickness thereof. Thus, a sectional area of a fluid channel through which a fluid flows may be controlled according to the thickness of each of the deformable membrane structures.

As illustrated in FIGS. 20A and 20B, the thickness of a deformable membrane 210 may be decreased continuously or in stages along a flow direction of a fluid.

Figure 21:
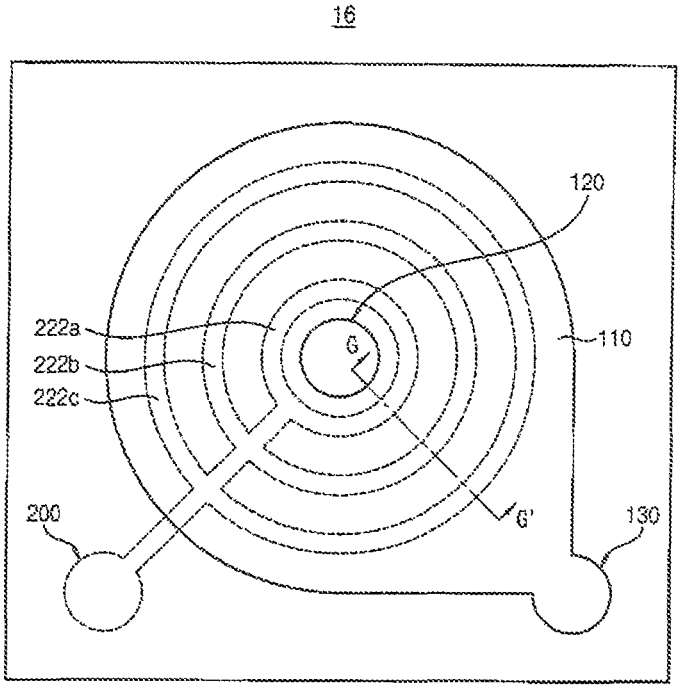
Figure 22:
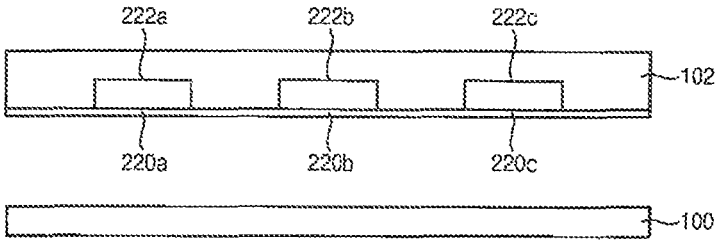

FIG. 21 is a plan view illustrating a particle processing device in accordance with example embodiments. FIG. 22 is a cross-sectional view taken along the line G-G' in FIG 21. The device is substantially the same as the particle processing device described with reference to FIG. 1 except for shapes and arrangements of a chamber and membrane control lines. Thus, the same reference numerals will be used to refer to the same or like elements and any further repetitive explanation concerning the above elements will be omitted.

Referring to FIGS. 21 and 22, a particle processing device 16 may include a chamber 110 having a circular shape. An input portion 120 may be disposed in the middle portion of the chamber 110 and an output portion 130 may be disposed in a peripheral portion of the chamber 110.

A first membrane control line 222*a* may include a recess which is formed in an inner wall of a chamber 110, that is, a surface of a second substrate 102 to extend in a concentric circular shape having a first radius. The first membrane control line 222*a* may extend to surround the input portion 120. A first deformable membrane structure 220*a* may cover the first membrane control line 222*a* to form a pressure line and constitute a portion of the inner wall of the chamber 110.

A second membrane control line 222*b* may include a recess which is formed in the inner wall of the chamber 110, that is, a surface of the second substrate 102 to extend in a concentric circular shape having a second radios greater than the first radius. The second membrane control line 222*b* may extend to surround the first membrane control line 222*a*. A second deformable membrane structure 220*b* may cover the second membrane control line 222*b* to form a pressure line and constitute a portion of the inner wall of the chamber 110.

A third membrane control line 222*c* may include a recess which is formed in the inner wall of the chamber 110, that is, a surface of the second substrate 102 to extend in a concentric circular shape having a third radius greater than the second radius. The third membrane control line 222*c* may extend to surround the second membrane control line 222*b*. A third deformable membrane structure 220*c* may cover the third membrane control line 222*c* to form a pressure line and constitute a portion of the inner wall of the chamber 110.

The first membrane control line 222*a* may be connected to a common pressure source 200 to deform the first deformable membrane structure 220*a* using an applied pressure. The second membrane control line 222*b* may be connected to the common pressure source 200 to deform the second deformable membrane structure 220*b* using an applied pressure. The third membrane control line 222*c* may be connected to the common pressure source 200 to deform the third deformable membrane structure 220*c* using an applied pressure.

Accordingly, the first to third deformable membrane structures may be deformed elastically by the pressure to control a sectional area of the chamber 110 such that a particle in the fluid may be detect and captured and the captured particle may be collected.

Figure 23:
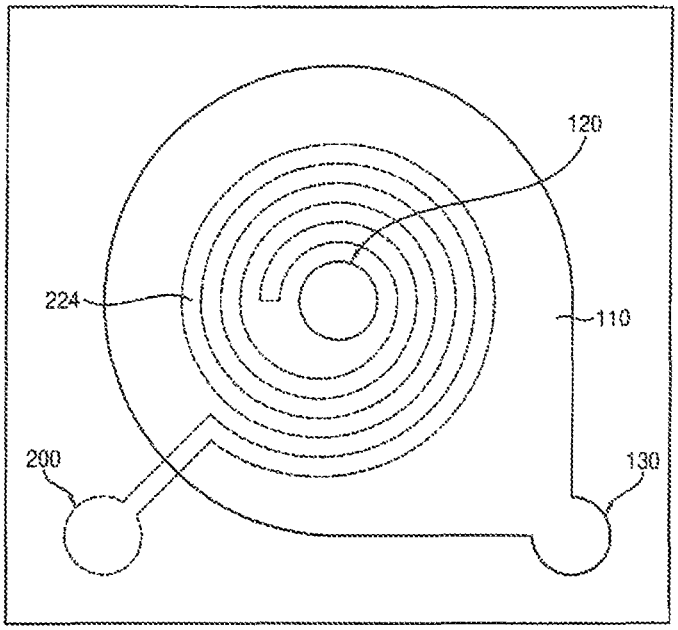

FIG. 23 is & plan view illustrating a particle processing device in accordance with example embodiments. The device is substantially the same as the particle processing device described with reference to FIG. 21 except for s shape of a membrane control line. Thus, the same reference numerals will be used to refer to the same or like elements and any further repetitive explanation concerning the above elements will be omitted.

Referring to FIG. 23, a particle processing device 17 may include a membrane control line 224 having a spiral shape.

The membrane control line 224 may include a recess which is formed in an inner wall of a chamber 110, that is, a surface of a second substrate 102 to extend in a spiral shape. The membrane control line 224 may extend in the spiral shape from an input portion. A width of the membrane control line 224 may be constant along the extending direction thereof. Alternatively, the width of the membrane control line 224 may be increased or decreased gradually along the extending direction thereof. A deformable membrane structure (not illustrated) may cover the membrane control line 224 to form a pressure line and constitute a portion of the inner wall of the chamber 110.

The membrane control line 224 may be connected to a common pressure source 200 to deform the deformable membrane structure using an applied pressure. Accordingly, the deformable membrane structure may be deformed elastic-ally by the pressure to control a sectional area of the chamber 110 such that a particle in the fluid flowing through the chamber 110 may be detect and captured and the captured particle may be collected.

Figure 24:
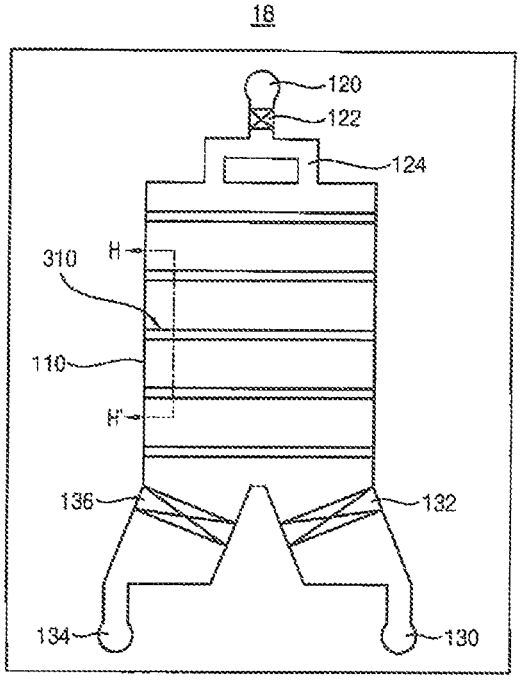
Figure 25:
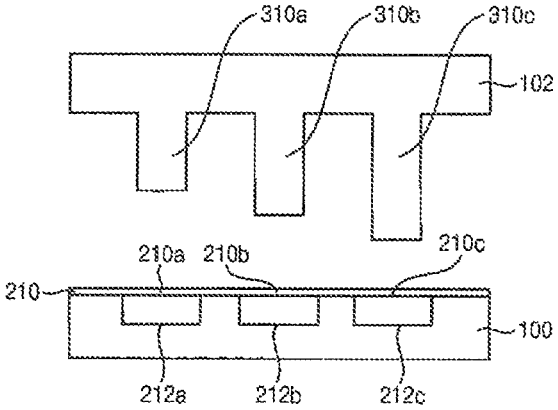
Figure 26A:
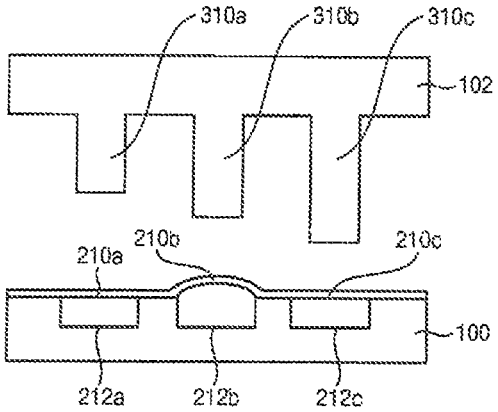
FIGS. 26A and 26B are cross-sectional views illustrating deformations of deformable membrane structures in FIG. 25.
Figure 26B:
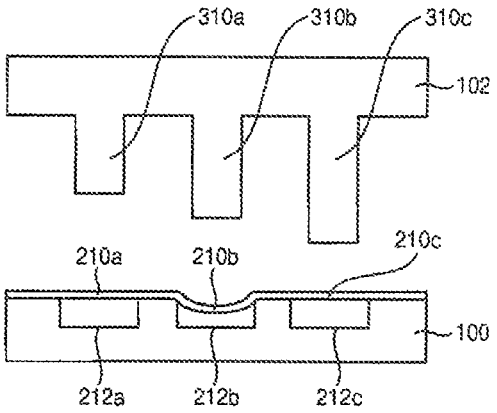
Figure 27:
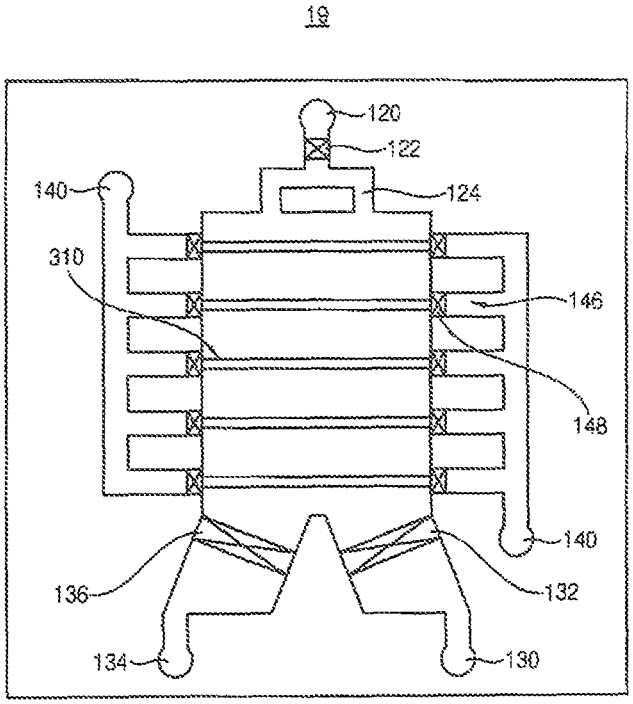

FIG. 24 is a plan view illustrating a particle processing device in accordance with example embodiments. FIG. 25 is a cross-sectional view taken along the line H-H' in FIG. 24. FIGS. 26A and 26B are cross-sectional views illustrating deformations of deformable membrane structures is FIG. 25. The device is substantially the same as the particle processing device described with, reference to FIG. 1 except, for a shape of a chamber and installation of fixed structures. Thus, the same reference numerals will be used to refer to the same or like elements and any further repetitive explanation concerning the above elements will be omitted.

Referring to FIGS. 24 to 26B, a particle processing device 18 may include a chamber 110, at least one fixed structure 310, at least one deformable membrane structure 210*a*, 210*b*, 210*c*, and at least one membrane control line 212*a*, 212*b*, 212*c*.

In example embodiments, the chamber 110 may include an input portion 120 and output portions 130, 134 at both end portions thereof. The chamber 110 may provide a space for fluid flow. The chamber 110 may have a polygonal sectional shape. A fluid may flow into the chamber 110 through the input portion 120 and flow out of the chamber 110 through the output portions 130, 134. For example, a fluid supply element (not illustrated) may be connected to the input portion 120 and the output portion 130, 134 to supply the fluid into the chamber or discharge the fluid from the chamber. An inlet valve 122 may be provided in the input portion 120, a first outlet valve 132 may be provided, in the first output portion 130, and a second outlet valve 136 may be provided in the second output portion 134.

First, second and third fixed structures 310*a*, 310*b*, 310*c* may be sequentially arranged in the chamber 110. The first, second and third fixed structures 310*a*, 310*b*, 310*c* may extend in a second direction substantially perpendicular to a first direction, that is, a flow direction of the fluid. The first, second and third fixed structures 310*a*, 310*b*, 310*c* may be spaced apart from each other in the first direction. The first, second and third fixed structures 310*a*, 310*b*, 310*c* may protrude a predetermined height from an inner wall of the chamber 110, respectively.

The first, second and third deformable membrane structures 210*a*, 210*b*, 210*c* may be formed on another inner wall of the chamber 110 respectively corresponding to the first, second and third fixed structures 310*a*, 310*b*, 310*c*. The first, second and third membrane control lines 212*a*, 212*b*, 212*c* may apply pressure to the first, second and third deformable membrane structures 210*a*, 210*b*, 210*c*, thereby deforming each of the deformable membrane structures.

Accordingly, the first second and third deformable membrane structures 210*a*, 210*b*, 210*c* may be deformed respectively to control a distance from each of the first, second and third fixed structures, In example embodiments, the particle processing device 18 may include a first substrate 100 and a second substrate 102. The second substrate 102 may be formed on the first substrate 100 such that the chamber and the membrane control lines may be defined between the first and second substrates 100 and 102.

As illustrated in FIGS. 24 and 25, an opening and recesses for forming the chamber and the membrane control lines may be formed in the first substrate 100, and recesses for forming the fixed structures may be formed in the second substrate 102. A deformable membrane 210 may be formed on the first substrate 100 to tightly seal the recesses such that the deformable membrane structures may be formed to constitute a portion of the inner wall of the chamber. For example, the deformable membrane 210 may be formed using PDMS. Accordingly, a surface of the second substrate 102 may constitute a first inner wall (upper wall) of the chamber 110 and a surface of the first substrate 100 may constitute a second inner wall (lower wall) of the chamber 110 opposite to the first inner wall.

The first fixed structure 310*a* may protrude from the first inner wall of the chamber 110, that is, the surface of the second substrate 102. For example, the first feed structure 310*a* may have a first height from the surface of the second substrate 102. The first fixed structure 310*a* may extend in the second direction. The first membrane control line 212*a* may include a recess which is formed in the second inner wall of the chamber 100, that is, the surface of the first substrate 102 to extend along the second direction corresponding to fee first fixed structure 310*a*. The first deformable membrane structure 210*a* may seal tightly the first membrane control line 212*a* to form a pressure line and constitute a portion of the second inner wall, of the chamber 110.

The second fixed structure 310*b* may protrude from the surface of the second substrate 102, For example, the second fixed structure 310*b* may have a second height greater than the first height from the surface of the second substrate 102. The second fixed structure 310*b* may extend in the second direction and be spaced apart from the first fixed structure 310*a* in the first direction. The second membrane control line 212*b* may include a recess which is formed in the surface of the first substrate 102 to extend along the second direction corresponding to the second fixed structure 310*b* and is spaced apart from the first membrane control line 212*a*. The second deformable membrane structure 210*b* may seal tightly the second membrane control line 212*b* to form a pressure line and constitute a portion of the second inner wall of the chamber 110.

The third fixed structure 310*c* may protrude from the surface of the second substrate 102, For example, the third fixed structure 310*c* may have a third height greater than the second height from the surface of the second substrate 102. The third fixed structure 310*c* may extend in the second direction and be spaced apart from the second fixed structure 310*b* in the first direction. The third membrane control line 212*c* may include a recess which is formed in the surface of the first substrate 102 to extend along the second direction corresponding to the third fixed structure 310*c* and is spaced apart from the second membrane control line 212*b*. The third deformable membrane structure 210*c* may seal tightly the third membrane control line 212*c* to form a pressure line and constitute a portion of the second inner wall of the chamber 110.

The first to third fixed structures 310*a*, 310*b*, 310*c* may have different heights from the surface of the second substrate 102. Alternatively, the first to third fixed structures 310*a*, 310*b*, 310*c* may have the same height.

The first to third membrane control lines 212*a*, 212*b*, 212*c* may be connected to individual pressure sources (not illustrated) respectively to be controlled independently. For example, a same pressure or a different pressure may be applied to the first to third membrane control lines 212*a*, 212*b*, 212*c*. A pressure may be applied at the same time to the first to third membrane control lines 212*a*, 212*b*, 212*c* to simultaneously deform the first to third deformable membrane structures 210*a*, 210*b*, 210*c*. Alternatively, a pressure may be applied at different times to the first to third membrane control lines 212*a*, 212*b*, 212*c* to independently deform the first to third deformable membrane structures 210*a*, 210*b*, 218*c*.

Alternatively, the first to third membrane control lines may be connected to a common pressure source (not illustrated). For example, a same pressure may be applied to the first to third membrane control lines.

As illustrated in FIG. 26A, when a positive pressure is applied to the second membrane control line 212*b* by the individual pressure source, the second deformable membrane structure 210*b* may be deformed toward the second fixed structure 310*b* to control a distance between the second fixed structure 310*b* and the second deformable membrane structure 310*b*. For example, the second deformable membrane structure 210*b* may be deformed by a positive pressure to form a capturing channel for selectively capturing & particle in the fluid in the chamber 110 to thereby serve as a filter. As the pressure of the second membrane control line 212*b* is decreased to be removed, the second deformable membrane structure 210*b* may return to its original position.

As illustrated in FIG. 26B, when a negative pressure is applied to the second membrane control line 212*b* by the individual pressure source, the second deformable membrane structure 210*b* may be deformed to be farther away from the second fixed structure 310*b* to control a distance between the second fixed structure 310*b* and the second deformable membrane structure 310*b*. For example, the second deformable membrane structure 210*b* may be deformed by a negative pressure to form a recovery channel for passing the capturing particle. As the pressure of the second membrane control line 212*b* is decreased to be removed, the second deformable membrane structure 210*b* may return to its original position.

Accordingly, the first to third deformable membrane structures may be deformed elastically by the pressure to control distances between the fixed structures and the deformable membrane structures such that the first to third deformable membrane structures may detect and capture a particle in the fluid and collect the captured particle.

Although it is not illustrated in the figures, electrode structures may be further provided on the first inner wall or the second inner wall of the chamber 110, the fixed structure or the deformable membrane structure. Additionally, a counter may be installed in the input portion and the output portion. Further, a biochemical material layer may be formed on the inner surface of the chamber or a surface treatment may be performed to change surface characteristics of the chamber, in order to increase or decrease an adhesive strength with the particle.

Hereinafter, a method of processing a particle using the particle processing device in FIG. 24 will be explained.

First, a fluid including a particle may flow too the chamber through the input portion 120. The fluid may flow into the chamber 110 through a distribution line 124 and then, the particle may be selectively separated through the fixed structures. A pressure may be applied to the deformable membrane structure corresponding to the fixed structure to control a distance between the fixed structure and the deformable membrane structure, and then, the particle may be collected through the first and second output portions 130, 134. Then, as the pressure is removed, the deformable membrane structure may return to its original position, and thus, another particle may be selectively separated through the fixed structure.

Accordingly, the particle processing device may include the fixed structure and the deformable membrane structure to perform various functions such as separating, counting, collecting and analyzing particles.

FIG. 21 is a plan view illustrating a particle processing device is accordance with example embodiments. The device is substantially the same as the particle processing device described with reference to FIG. 24 except for a shape of a chamber and installation of fixed structures. Thus, the same reference numerals will be used to refer to the same or like elements and any further repetitive explanation concerning the above elements will be omitted.

Referring to FIG. 21, a particle processing device 19 may include a chamber 110, at least one fixed structure 310, at least one deformable membrane structure, at least one membrane control line, and at least one recovery line 146. The recovery line 146 may be connected to the chamber 110 such that a particle processed by the fixed structure and the deformable membrane structure may be collected through the recovery line.

In example embodiments, a plurality of recovery lines 146 may the formed to be spaced apart from each other along both side portions of the chamber 110. The recovery line 146 may extend corresponding to the membrane control line and the fixed structure. The recovery lines 146 may be connected to a common recovery portion 140. Alternatively, the recovery lines 146 may be connected to individual recovery portions (not illustrated) respectively. A control means may be provided in the recovery line 146 to control fluid flowing through the recovery line. The control means may include a recovery valve 148 for opening sad closing the recovery line. The recovery valve may be actuated by a pressure through a valve control line (not illustrated).

Accordingly, the recovery line 146 may be connected to the chamber 110 to be used for a recovery path for collecting the particles processed by the deformable membrane structures. Thus, the captured particle may be collected through the recovery line 146, thereby performing multi-stage separation.

As mentioned above, desired particles of the particles separated by the fixed structure may be selectively collected through the output portion or the recovery line, thereby improve purity of the collected particles.

Figure 28:
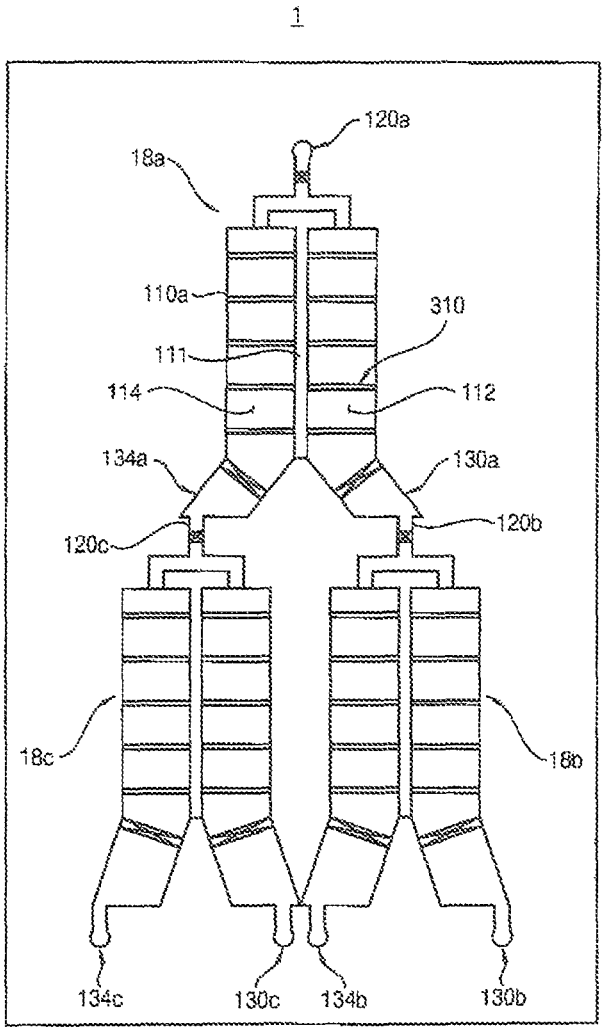

FIG. 28 is a plan view illustrating a particle processing device in accordance with example embodiments. The device is substantially the same as the particle processing device described with reference to FIG. 24 except for a barrier structure installed within a chamber. Thus, the same reference numerals will be used to refer to the same or like elements and any further repetitive explanation concerning the above elements will be omitted.

Referring to FIG. 28, a particle processing system 1 may include a plurality of particle processing devices 18*a*, 18*b*, 18*c*, In example embodiments, a chamber 110*a* of the particle processing device may include two processing regions 112, 114 which are separated by a barrier structure 111 and arranged in parallel with each other. The harrier structure 111 may extend along the middle portion of the chamber 110. The barrier structure 111 may extend from an upper wall to a lower wall of the chamber 110*a*. Accordingly, a fluid may flow into the first and second regions 112, 114 in parallel through an input portion 120 and a distribution line 124, and then, a particle in the fluid may be selectively separated by fixed structures.

A plurality of the particle processing devices 18*a*, 18*b*, 18*c* may be arranged in series, in parallel or in a combination thereof. As illustrated in FIG. 5, the first processing device 18*a* may be connected in series to the second processing device 18*b*, The first processing device 18*a* may be connected in series to the third processing device 18*c*. The second processing device 18*b* and the third processing device 18*c* may be arranged in parallel with each other.

A first output portion 130*a* of the first processing device 18*a* may be connected to an input portion 120*b* of the second processing device 18*b*. The first processing region 112 of the first processing device 18*a* may be connected to the second processing device 18*b* through the first input portion 130*a*, A second output portion 134*a* of the first processing device 18*a* may be connected to an input portion 120*c* of the third processing device 18*c*. The second processing region 114 of the first processing device 18*a* may be connected to the third processing device 18*c* through the second input portion 134*a*. Although it is not illustrated in the figures, the second and third processing devices 18*b*, 18*c* may be connected to another particle processing devices.

Accordingly, particles processed in a first stage may be processed in following multi stages of a plurality of processing devices, to thereby improve purity and throughput of the particles.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims, in the claims, means-plus-function clauses are intended to cover the structures described herein as performing the recited function and not only structural equivalents but also equivalent structures. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A particle processing device, comprising:

a chamber including an input portion and an output portion and providing a space for flowing of a fluid having a particle;

at least first and second deformable membrane structures sequentially arranged in a first direction from the input portion to the output portion in the chamber and controlling a sectional area of a fluid path through which the fluid flows;

a first membrane control line applying pressure to and deforming the first deformable membrane structure to form a first fluid channel in the chamber, the first fluid channel having a first sectional area for selectively capturing a first particle in the fluid;

a second membrane control line applying pressure to and deforming the second deformable membrane structure to form a second fluid channel for selectively capturing a second particle in the fluid, the second fluid channel having a second sectional area less than the first sectional area for selectively capturing a second particle less than the first particle in the fluid;

first and second recovery lines connected to the chamber and extending from the chamber corresponding to the first and second deformable membrane structures such that the particles captured by the first and second deformable membrane structures are collected through the corresponding first and second recovery lines respectively;

first and second deformable valve structures for opening and closing the first and second recovery lines respectively; and first and second valve control lines applying pressure to and deforming the first and second deformable valve structures respectively to close the corresponding first and second recovery lines;

wherein when the applied pressure to the first and second deformable membrane structures and the first and second deformable valve structures is removed, the first and second deformable membrane structures and the first and second deformable valve structures return to their original positions respectively.

2. The particle processing device of claim 1, wherein each of the first and second membrane control lines comprises a recess which is formed in an inner wall of the chamber to extend along a direction substantially perpendicular to a flow direction of the fluid.

3. The particle processing device of claim 2, wherein each of the first and second deformable membrane structures seals tightly each of the first and second membrane control lines to constitute a portion of the inner wall of the chamber.

4. The particle processing device of claim 1, wherein each of the first and second membrane control line is connected to a pressure source to deform each of the first and second deformable membrane structures by the applied pressure.

5. The particle processing device of claim 1, wherein the first deformable membrane structure deformed by the first membrane control line has a first width and the second deformable membrane structure deformed by the second membrane control line has a second width different from the first width.

6. The particle processing device of claim 1, wherein the first deformable membrane structure has a first thickness and the second deformable membrane structure has a second thickness different from the first thickness.

7. The particle processing device of claim 1, wherein a first pressure is applied to the first deformable membrane structure and a second pressure different from the first pressure is applied to the second deformable membrane structure.

8. The particle processing device of claim 1, wherein each of the first and second valve control line comprises a recess which extends in an inner wall of each of the first and second recovery lines, and each of the first and second deformable valve structures seals tightly each of the first and second valve control line to constitute a portion of the inner wall of each of the first and second recovery lines.

9. The particle processing device of claim 8, wherein the first valve control line and the first membrane control line are connected to each other to be one recess and the first deformable valve structure and the first deformable membrane structure are connected to each other to be one deformable membrane.

10. The particle processing device of claim 1, further comprising a biochemical material layer coated on the inner wall of the chamber or on each of the first and second deformable membrane structures.

11. The particle processing device of claim 10, wherein a particle captured by each of the first and second deformable membrane structures is adhered to and cultivated on the material layer.

12. The particle processing device of claim 10, wherein the particle captured by each of the first and second deformable membrane structures is secondly separated by a biochemical reaction with the material layer.

13. The particle processing device of claim 1, further comprising an additional structure on an inner wall of the chamber or on each of the first and second deformable membrane structures to control the first and second sectional areas of the first and second fluid channels through which the fluid flows.

14. The particle processing device of claim 1, further comprising a guiding structure on an inner wall of the chamber adjacent to the first and second deformable membrane structures to control a flow direction of the fluid.

15. The particle processing device of claim 1, further comprising a pair of electrodes an inner wall of the chamber adjacent to the first and second deformable membrane structures.

* * * * *